US008403593B2

(12) United States Patent
Dagesse

(10) Patent No.: US 8,403,593 B2
(45) **Date of Patent: *Mar. 26, 2013**

(54) RIG MAT SYSTEM USING PANELS OF COMPOSITE MATERIAL

(75) Inventor: Paul J. Dagesse, Beaverlodge (CA)

(73) Assignee: Rhinokore Composites Manufacturing Partnership, Armstrong, British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/301,126

(22) Filed: Nov. 21, 2011

(65) Prior Publication Data

US 2012/0163910 A1 Jun. 28, 2012

Related U.S. Application Data

(62) Division of application No. 12/480,011, filed on Jun. 8, 2009, now Pat. No. 8,061,929.

(60) Provisional application No. 61/059,447, filed on Jun. 6, 2008.

(51) Int. Cl.
*E04C 2/38* (2006.01)
*E04F 15/00* (2006.01)

(52) U.S. Cl. ..... 404/41; 404/34; 404/35; 404/36; 404/44

(58) Field of Classification Search ..... 404/34–36, 404/40, 41–44
See application file for complete search history.

(56) References Cited

U.S. PATENT DOCUMENTS

| | | | | |
|---|---|---|---|---|
| 2,430,200 | A | | 11/1947 | Wilson |
| 3,348,459 | A | | 10/1967 | Harvey |
| 3,564,801 | A | | 2/1971 | Huerta |
| 3,602,110 | A | | 8/1971 | Wiggins |
| 3,694,983 | A | | 10/1972 | Couquet |
| 3,859,000 | A | | 1/1975 | Webster |
| 4,221,502 | A | * | 9/1980 | Tanikawa ..... 405/126 |
| 4,703,597 | A | * | 11/1987 | Eggemar ..... 52/220.2 |
| 4,845,907 | A | | 7/1989 | Meek |
| 5,032,037 | A | | 7/1991 | Phillips et al. |
| 5,797,237 | A | | 8/1998 | Finkell, Jr. |
| 5,971,655 | A | | 10/1999 | Shirakawa |
| 6,652,183 | B2 | | 11/2003 | Stasiewich et al. |
| 6,676,785 | B2 | | 1/2004 | Johnson et al. |
| 7,160,055 | B2 | | 1/2007 | Beamish et al. |
| 7,415,741 | B1 | | 8/2008 | Wasley et al. |
| 7,608,313 | B2 | | 10/2009 | Solomon et al. |
| 7,641,963 | B2 | | 1/2010 | Grafenauer |
| 2003/0233809 | A1 | | 12/2003 | Pervan |
| 2007/0250025 | A1 | | 10/2007 | Sams et al. |
| 2009/0142542 | A1 | | 6/2009 | Halahmi et al. |

FOREIGN PATENT DOCUMENTS

| | | |
|---|---|---|
| CA | 2348328 | 2/2002 |
| CA | 2364968 | 6/2003 |

* cited by examiner

*Primary Examiner* — Raymond W Addie
(74) *Attorney, Agent, or Firm* — Wong, Cabello, Lutsch, Rutherford & Brucculeri, LLP

(57) ABSTRACT

A rig mat is formed by rectangular panels fastened end to end by cooperating connectors. In one arrangement the first connector is C-shaped shaped to form a slot and the second T-shaped shaped with a flange of the T wider than the mouth inserted through the mouth. In a second arrangement two L shaped connectors are interengaged with an additional flat plate which defines a slot with an end of one of the L-shaped connectors. The panels are composite and formed from a honeycomb core panel with a foam material filling the tubular cells and a fibrous reinforcing cover sheets extending over the top and bottom of the panel. The cover sheets are filled with a set resin material which extends into the porous fibrous material of the walls of the core panel so as to form an integral structure of the resin extending between the walls and the sheets.

9 Claims, 4 Drawing Sheets

RIG MAT SYSTEM USING PANELS OF COMPOSITE MATERIAL

CROSS REFERENCE TO RELATED APPLICATIONS

This Application is a divisional of U.S. patent application Ser. No. 12/480,011, filed Jun. 8, 2009, which is incorporated by reference herein in its entirety for all purposes and which claims the benefit under 35 U.S.C. 119 of U.S. Provisional Application Ser. No. 61/059,447 filed Jun. 6, 2008.

This invention relates to a rig mat system where a plurality of rectangular panels are laid side by side and fastened end to end in an array to cover rough ground to form a support surface which can be suitable for pedestrian traffic or for heavy equipment, depending on the strength of the materials selected.

This application relates to the panel disclosed and claimed in application Ser. No. 12/355,827 filed Jan. 19, 2009 which corresponds to Canadian application 2,639,673 filed Oct. 22, 2008. The panel used herein can be of the type disclosed in the above application or other composite panels can be used.

This invention can use the composite material described in the above application which is formed from a panel of a foam filled honeycomb cell material covered on top and bottom surfaces by a resin filled sheet. However the panel can also be formed from other materials or using other techniques including conventional wood panels.

BACKGROUND OF THE INVENTION

Rig mat systems of this general type are shown in Canadian Patents No: 2,348,328 issued Oct. 22, 2002 and 2,364,968 issued Jun. 22, 2004 both to David and James Stasiewich.

Another arrangement is shown in U.S. Pat. No. 7,160,055 of Beamish issued Jan. 9, 2007.

These all provide arrangements for connecting the panels each to the next to integrate the structure so that the panels do not separate as the heavy vehicles pass over.

However these arrangements are not entirely suitable leaving opportunity for an improved system of connecting the panels end to end.

The panels used can be of the type described below or may be of other constructions. However the mounting arrangement is particularly designed for use with the panels described herein.

A number of prior proposals have been made for manufacturing a composite core panel formed from a honeycomb panel formed with tubular cells at right angles to the panel where the panel is filled with a reinforcing foam extending through the cells so as to provide an enhanced compression strength of the core in a direction longitudinally of the cells. This strength is commonly significantly greater than the compression strength of the core and the foam separately. The core panel is then covered on top and bottom by reinforcing sheets of a fibrous reinforcing material which are then resin filled by a resin impregnation process, for example infusion, so as to attach the top and bottom sheets to the foam and honeycomb core panel. The compression strength of the core panel has a direct relationship to the shear strength of the finished panel so that it has been desirable to maximize this compression strength. Such panels have become widely used for many products.

The materials commonly used for the honeycomb panel are phenolic paper, aluminum and various types of plastic materials. The selection is made in part dependent on cost relative to the desired strength with the aluminum of course providing the highest strength at the highest cost. Phenolic paper is the simplest and cheapest option and is very widely used. The honeycomb, in many cases, is formed by bonding strips side by side with the tubular cells formed around rods or simply by stretching the bonded strips longitudinally of the panel to open them up. Adhesive and heat sealing can be used for attaching the strips.

However there is always an ongoing requirement for yet further increasing the strength of such panels to enable additional markets to be entered or for strength requirements to be met with a thinner panel of less material.

SUMMARY OF THE INVENTION

It is one object of the invention to provide a rig mat system of the above type.

According to one aspect of the invention there is provided a rig mat system comprising:

a plurality of rectangular panels arranged to be laid side by side and fastened end to end in an array to cover rough ground to form a support surface;

each panel having a mounting arrangement defining two ends of the panel for connection to a next adjacent panel having a similar mounting arrangement;

a first end of the mounting arrangement having a first connecting member extending along the end which is C-shaped shaped in cross section so as to define a hollow interior with a top flange and a bottom flange, the top flange facing downwardly and the bottom flange facing upwardly so as to define an open mouth therebetween;

a second end of the mounting arrangement having a second connecting member extending along the end which is T-shaped shaped in cross section with a generally upstanding flange connected to the end face of the panel by a connecting bar which is generally at right angles to the upstanding flange and connects to the upstanding flange so as to provide an upwardly extending portion above the bar and a downwardly extending portion below the bar;

the upstanding flange having a height greater than the height of the open mouth and the bar having a length from the upstanding flange to the end face of the panel such that the upstanding flange is inserted through the mouth by tilting the panel and such that the upstanding flange is prevented from escaping from the mouth by horizontal movement.

Preferably the mounting arrangement includes two side members each connected to the first and second connecting members and each extending along a respective side of the panel.

Preferably at least one and preferably all of the members include a C-shaped channel facing the panel and into which an edge of the panel is inserted. The top and bottom surfaces of the panel can be recessed to receive the C-channel.

Alternatively the members can be fastened to the panel. For example the members can be formed integrally with the panel and fastened to the panel by common resin material engaged therein.

In one arrangement, the members can be formed of metal with the members being connected at the ends by welding.

Alternatively the members can be formed of pultruded fiber reinforced resin material.

Preferably the connecting members are coextensive with the end face of the panel in length and height. However they may not extend along the full length. Also the C-channel of the first member may not be the full height of the panel.

Preferably the C-channel has top and bottom flanges which are horizontal and coplanar with the face of the panel.

Preferably the composite panel comprises:

a honeycomb core panel having a first face and a second opposite face with an array of generally hexagonal tubular cells defined by walls of the core panel extending between the first and second faces;

a foam material filling the tubular cells;

a first fibrous reinforcing cover sheet extending over the first face of the core panel;

a second fibrous reinforcing cover sheet extending over the second face of the core panel;

the first and second cover sheets being filled with a set resin material;

the walls of the honey comb core panel being formed from a porous fibrous material;

the set resin in the cover sheets extending from the cover sheets into the porous fibrous material of the walls of the core panel so as to form an integral structure of the resin extending between the walls and the face sheets.

According to a second aspect of the invention there is provided a rig mat system comprising:

a plurality of rectangular panels arranged to be laid side by side and fastened end to end in an array to cover rough ground to form a support surface;

each panel having a mounting arrangement defining two ends of the panel for connection to a next adjacent panel having a similar mounting arrangement;

wherein each panel comprises:

a honeycomb core panel having a first face and a second opposite face with an array of generally hexagonal tubular cells defined by walls of the core panel extending between the first and second faces;

a foam material filling the tubular cells;

a first fibrous reinforcing cover sheet extending over the first face of the core panel;

a second fibrous reinforcing cover sheet extending over the second face of the core panel;

the first and second cover sheets being filled with a set resin material.

According to a third aspect of the invention there is provided a rig mat system comprising:

a plurality of rectangular panels arranged to be laid side by side and fastened end to end in an array to cover rough ground to form a support surface;

each panel having a first surface and a second opposed parallel surface, a first end and second end;

each panel having a mounting arrangement defining the first and second ends of the panel for connection at the first end to a corresponding second end of a next adjacent panel having a cooperating mounting arrangement;

a first end of the mounting arrangement having a first connecting member extending along the first end which is generally L-shaped with a first plate attached to the first surface and a first flange substantially at right angles to the first plate;

a second end of the mounting arrangement having a second connecting member extending along the second end which is generally L-shaped with a second plate attached to the second surface and a second flange substantially at right angles to the second plate;

the first and second flanges being arranged in opposed directions so that one can engage over the other to hold the panels against movement away from one another;

and a third plate attached to the second surface at the first end and extending from the second surface to a position beyond the first end of the panel and underlying the first flange to define with an end of the first flange a slot through which the second flange is inserted.

Preferably the first plate and the third plate are fastened together at the end of the first panel by a series of fasteners passing through the first panel.

Preferably there is provided a fourth plate attached to the first surface at the second end and wherein the second plate and the fourth plate are fastened together at the end of the second panel by a series of fasteners passing through the second panel.

Preferably the walls of the honey comb core panel are formed from a porous fibrous material and the set resin in the cover sheets extends from the cover sheets into the porous fibrous material of the walls of the core panel so as to form an integral structure of the resin extending between the walls and the sheets.

Preferably the resin substantially fills the material of the core walls and preferably the resin extends through the core walls from the first sheet to the second sheet. However the first intention is that the resin acts firstly to form an integral connection between the layers defined by the face sheets and the core walls so as to provide and increased resistance to shear forces tending to delaminate the structure at the junction between the sheet and the core. Hence, it will be appreciated that, in order to achieve this requirement, the resin may not extend fully through the structure to form the tubular reinforcement. Thus other resins can be used in the core material provided they do not interfere with the formation of the integral connection.

Secondly the intention is that the resin forms an increased compression resistance in the core panel by forming a series of resin reinforced tubes through the panel at the walls. Hence, it will be appreciated that, in order to achieve this requirement, the resin may not extend fully into each and every pore or space in the walls but the resin will extend into the structure sufficiently to form the integral connection at the sheets and the tubular reinforcement extending through the panel.

It will be appreciated that the walls generally do not contain any existing resin filling material when the resin introduction occurs since this will prevent or inhibit the penetration of the resin into the walls and the formation of the tubular structures through the panel and the integral connection to the sheets. However the walls may contain some reinforcing resin provided it does not prevent the formation of the integral connection.

Preferably the resin is a thermosetting resin such as thermosetting polyester. However other types of resin can be used such as polyurethane or epoxy, vinyl ester, phenolic resin.

Preferably the walls are connected each to the next to form the honeycomb panel by a heat seal. This is preferred as the heat seals are less likely to interfere with the entry of the resin during the resin introduction process and are easier to effect and less expensive. However adhesive connection may be used.

Preferably the walls are formed from a non-woven fibrous material such as a spun bond fibrous plastics material. However the material selected can be of any construction provided it is porous so as to allow the penetration of the resin during the resin introduction step. Thus of course aluminum and plastics film cannot be used. The material should also bond to the foam during the foam filling step. The compressive strength of the material in the honeycomb construction is of less importance and can be quite low in comparison with other materials, such as those conventionally used, provided it is sufficient to allow the foam filling step to occur.

Preferably the sheets contain glass reinforcing fibers as these are inexpensive and are known to provide the required strength characteristics. However other reinforcing fibers can be used.

One particular end use for panels of the present invention is that used for a panel of a rig mat that is a panel which when connected edge to edge with other panels forms a ground cover for heavy equipment and the like without the need to pave. Such rig mats for heavy equipment and lighter mats for persons and lighter equipment are very widely used in the oil and similar industries. However other end uses of the stronger panels of the present invention are in the fields of marine (boat hull, transom, stringer, bulkhead, decks), wind energy, sporting/recreational applications (skis, snowboards), transportation (heavy equipment such as trucks, tractors, buses, RV, automotive), load bearing panels for construction of buildings, modular housing, flooring.

While the term "honeycomb" is used generally and in this document it will be appreciated that the tubular cells formed are generally not accurately hexagonal in cross section, particularly where, as described herein, the cells are formed from a porous fibrous material without reinforcing resin available during the filling process to maintain a regular shape of the cells.

BRIEF DESCRIPTION OF THE DRAWINGS

One embodiment of the invention will now be described in conjunction with the accompanying drawings in which.

In the drawings like characters of reference indicate corresponding parts in the different figures.

DESCRIPTION OF EMBODIMENTS

Figure 1:
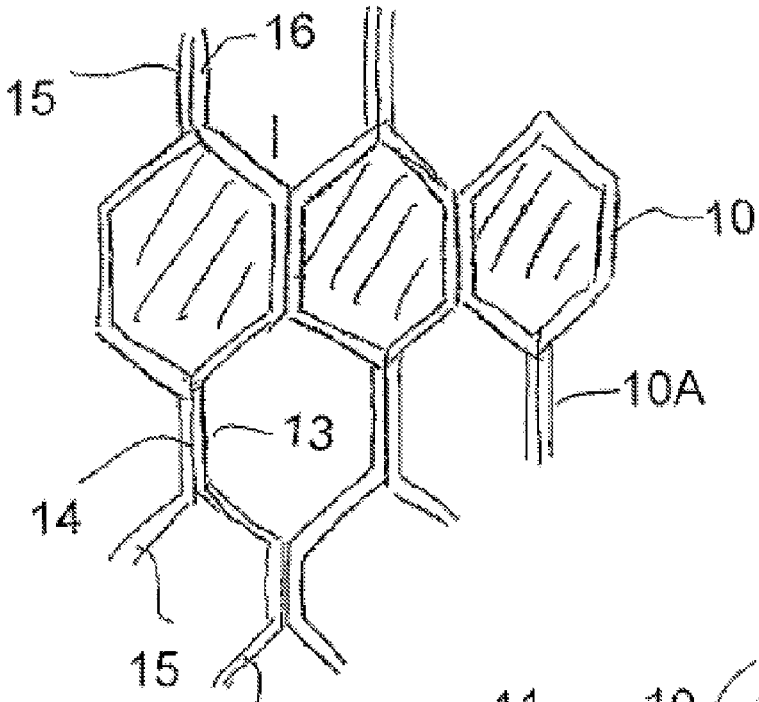
FIG. 1 is horizontal cross sectional view through a panel to be used in the present invention.
Figure 2:
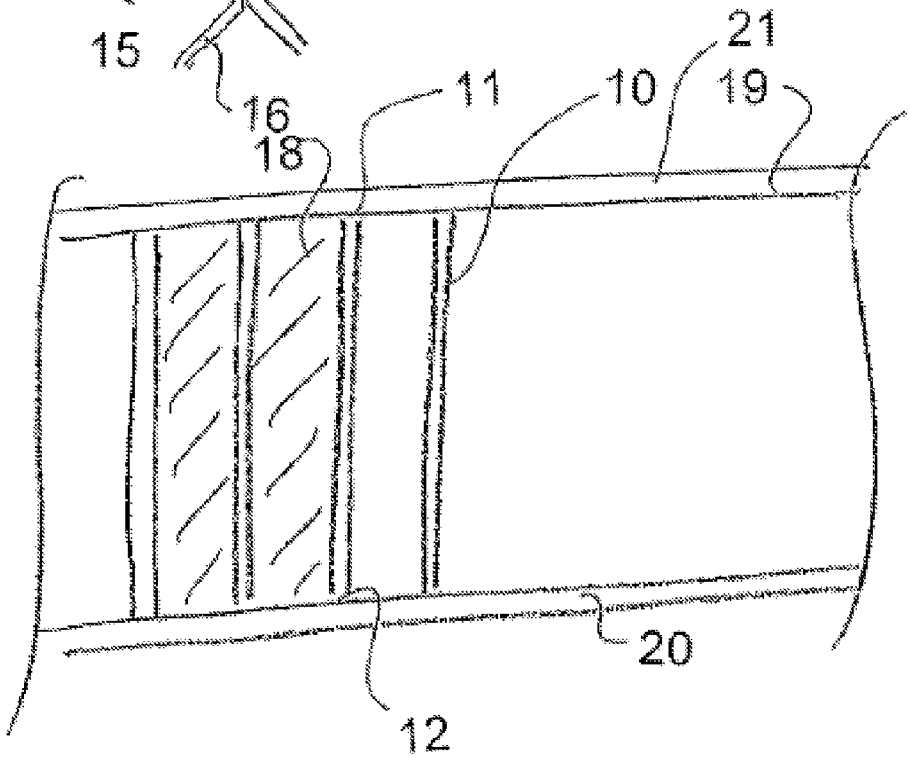
FIG. 2 is a vertical cross sectional view through the panel of FIG. 1.
Figure 3:
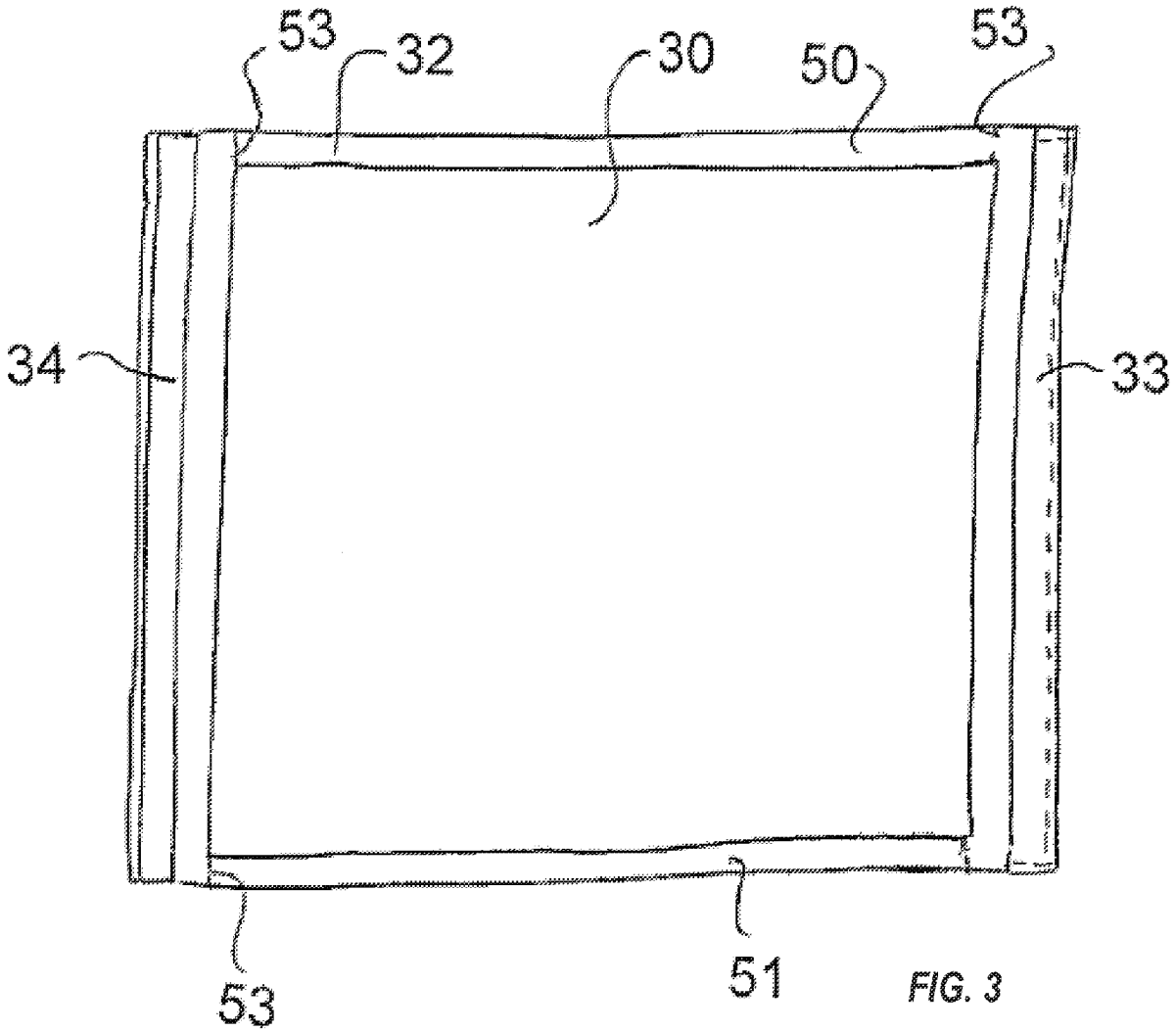
FIG. 3 is a plan view of a panel of FIG. 1 mounted in a connecting frame for a rig mat system.

The composite panel described in general above is shown in FIGS. 1 and 2 and is formed by a honeycomb core panel 10 having a first face 11 and a second opposite face 12 with an array of generally hexagonal tubular cells defined by walls 10A of the core panel extending between the first and second faces. The cells are formed from strips 15, 16 arranged side by side of a porous fibrous material which is heat sealed at a sealing line 14 to define the generally hexagonal cells.

A foam material such as a polyurethane foam 18 fills the tubular cells.

A first fibrous reinforcing cover sheet such as a fiberglass mat (or carbon fiber, aramid fiber, Kevlar fiber, polyester fiber, natural fiber—e.g. hemp, flax, straw) 19 extends over the first face 11 of the core panel and a second fibrous reinforcing cover sheet 20 extends over the second face of the core panel.

The first and second cover sheets are filled with a set resin material 21 which extends from the cover sheets 19, 20 into the porous fibrous material of the walls 15, 16 of the core panel so as to form an integral structure of the resin extending between the walls and the sheets.

The panel described above can be formed into a rig mat system which provides a plurality of rectangular panels arranged to be laid side by side and fastened end to end in an array to cover rough ground to form a support surface.

Each panel 30, 31 have a mounting frame 32 defining two ends 33, 34 of the panel for connection to a next adjacent panel having a similar frame. A first end of the frame has a first connecting member 33 extending along the end which is C-shaped shaped in cross section so as to define a hollow interior 35 with top and bottom horizontal flanges 38 and 39 and a top vertical flange 36 and a bottom vertical flange 37, the top flange facing downwardly and the bottom flange facing upwardly so as to define an open mouth 40 therebetween. While the C-shaped member is preferably rectangular, this is not essential and it may have curved flanges.

A second end 34 of the frame having a second connecting member extending along the end which is T-shaped shaped in cross section with a generally upstanding flange 41 connected to the end face of the panel by a connecting bar 42 which is generally at right angles to the upstanding flange 41 and connects to the upstanding flange so as to provide an upwardly extending portion 43 above the bar and a downwardly extending portion 44 below the bar.

The upstanding flange 41 has a height greater than the height of the open mouth 40 and the bar 42 has a length from the upstanding flange to the end face of the panel such that the upstanding flange is inserted through the mouth by tilting the panel and leading the top portion 43 through the open mouth until the flange 41 is wholly within the hollow interior. The upstanding flange is prevented from escaping from the mouth by horizontal movement because the flange 41 is of greater height than the mouth and thus cannot escape.

The frame includes two side members 50 and 51 each connected to the first and second connecting members 33 and 34 and each extending along a respective side of the panel. The members can be formed of metal with the members being connected at the ends by welded butt joints 53 or welded miter joints (not shown).

Each of the members includes a C-shaped channel 48 facing the panel and into which an edge 49 of the panel is inserted. The top and bottom surfaces 58, 59 of the panel are recessed by the thickness of the wall of the C-channel to receive the C-channel to that the top and bottom surfaces of the C-channel are coplanar with the top and bottom surfaces respectively of the panel itself.

Figure 5:
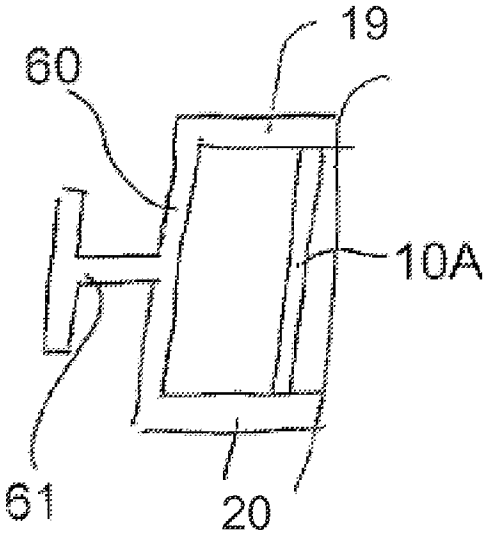
FIG. 5 is a cross sectional view through one of the panels of FIG. 1 showing an alternative form of the connection.
Figure 4:
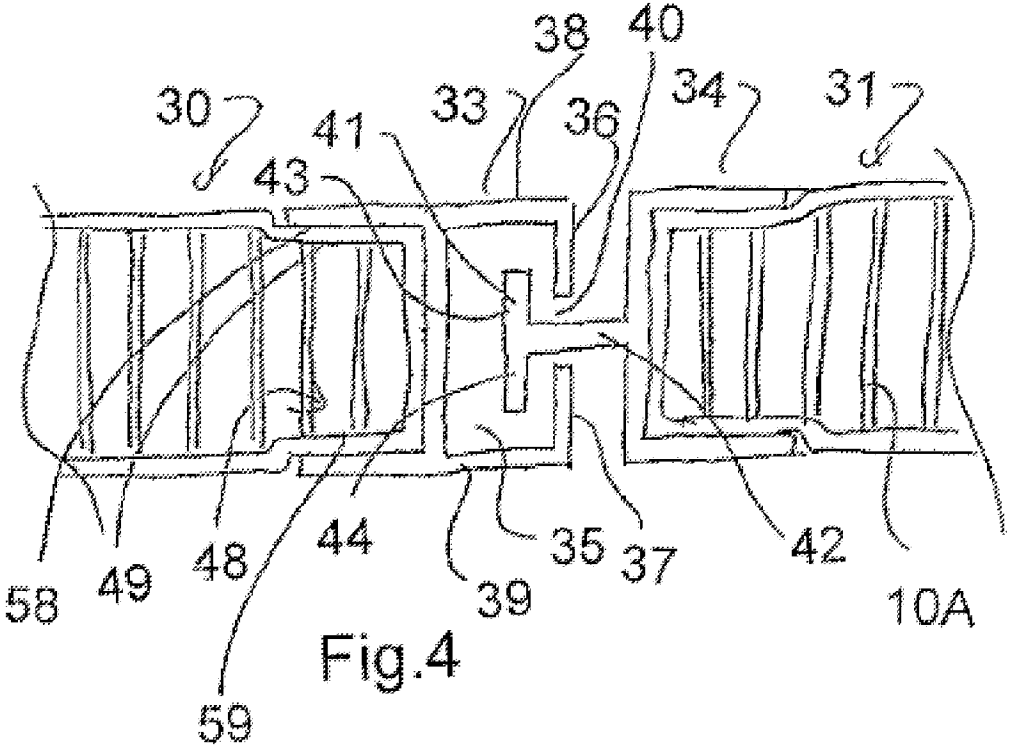
FIG. 4 is a cross sectional view through the connection between two panels of FIG. 1 for the rig mat system.

As shown in FIG. 5, the side and end members are fastened to the panel and formed integrally with the panel and fastened to the panel by common resin material engaged therein which extends from the top and bottom walls 19, 20 of the panel through the tube walls 10A. The end walls of the panel are shaped to form the end couplings as previously described which are integral with the panel and formed by the reinforcing sheets at top and bottom which are brought together and connected by the injected resin to form the end wall 60 and the T-bar 61.

Figure 6:
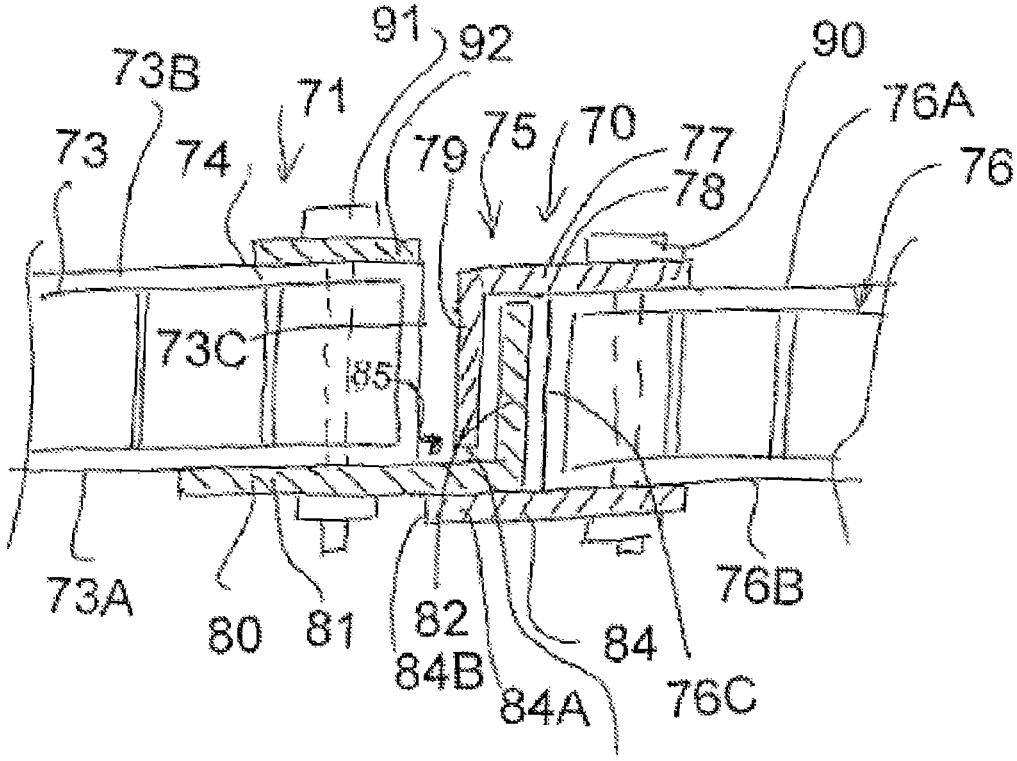
FIG. 6 is a cross sectional view through two of the panels of FIG. 1 showing a further alternative form of the connection.

In FIG. 6 is shown an alternative arrangement for the end couplings 70 and 71 at the ends 49 of the panels.

At the first end 75 of the first panel 76, the first end coupling 70 of the mounting arrangement has a first connecting member 77 extending along the first end which is generally L-shaped with a first plate 78 attached to the first surface 76A of the panel 76 and a first flange 79 substantially at right angles to the first plate 78.

At the second end 74 of the second panel 73, the second end coupling 71 of the mounting arrangement has a second connecting member 80 extending along the second end which is generally L-shaped with a second plate 81 attached to the second surface 73A of the panel 73 and a second flange 82 substantially at right angles to the second plate 81.

The first and second flanges 79, 82 are arranged in opposed directions so that one can engage over the other to hold the panels against movement horizontally away from one another.

A third plate 84 is attached to the second surface 76B of the panel 76 at the first end and extends from the second surface 76B to an end 84B outwardly beyond a position 84A beyond the first end 76C of the first panel 76 and underlying a bottom end 79A of the first flange 79 to define with the end 79A of the first flange 79 a slot 85 through which the second flange 82 is inserted. The slot 85 locates the flange 82 and the plate 81 and prevents downward movement of the plate 81 which sits on the plate 84.

The first plate 78 and the third plate 84 are fastened together at the end of the first panel by a series of fasteners 90 passing through the first panel 76 adjacent the edge 76C thus clamping the plates to the edge of the panel.

The second plate is attached to the end 73C of the second panel 73 by a fourth plate 92 attached to the first surface 73B with the second plate and the fourth plate being fastened together at the end of the second panel 73 by a series of fasteners 91 passing through the second panel and clamping the plates to the panel.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A rig mat system comprising:

a plurality of rectangular panels arranged to be laid side by side and fastened end to end in an array to cover rough ground to form a support surface;

each panel having a mounting arrangement defining two ends of the panel for connection to a next adjacent panel having a similar mounting arrangement;

a first end of the mounting arrangement having a first connecting member extending along the end which is C-shaped in cross section so as to define a hollow interior with a top flange and a bottom flange, the top flange facing downwardly and the bottom flange facing upwardly so as to define an open mouth therebetween;

a second end of the mounting arrangement having a second connecting member extending along the end which is T-shaped in cross section with a generally upstanding flange connected to an end face of the panel by a connecting bar which is generally at right angles to the upstanding flange and connects to the upstanding flange so as to provide an upwardly extending portion above the bar and a downwardly extending portion below the bar;

the upstanding flange having a height greater than the height of the open mouth and the bar having a length from the upstanding flange to the end face of the panel such that the upstanding flange is inserted through the mouth by tilting the panel and such that the upstanding flange is prevented from escaping from the mouth by horizontal movement, wherein the mounting arrangement includes two side members each connected to the first and second connecting members and each extending along a respective side of the panel.

2. The rig mat system according to claim 1 wherein at least one of the members includes a C-shaped channel facing the panel and into which an edge of the panel is inserted.

3. The rig mat system according to claim 1 wherein at least one of the members is fastened to the panel.

4. The rig mat system according to claim 1 wherein at least one of the members is formed integrally with the panel and fastened to the panel by common resin material engaged therein.

5. The rig mat system according to claim 1 wherein at least one of the members is formed of metal with the members being connected at the ends by welding.

6. The rig mat system according to claim 1 wherein at least one of the members is formed of pultruded fiber reinforced resin material.

7. The rig mat system according to claim 1 wherein the connecting members are coextensive with the end face of the panel in length and height.

8. The rig mat system according to claim 1 wherein each panel comprises:

a honeycomb core panel having a first face and a second opposite face with an array of generally hexagonal tubular cells defined by walls of the core panel extending between the first and second faces, formed from a porous fibrous material;

a foam material filling the tubular cells;

a first fibrous reinforcing cover sheet extending over the first face of the core panel; and a second fibrous reinforcing cover sheet extending over the second face of the core panel, wherein the first and second fibrous reinforcing cover sheets are filled with a set resin material that extends from the cover sheets into the porous fibrous material of the walls of the core panel so as to form an integral structure of the resin extending between the walls and the sheets.

9. A rig mat system comprising:

a plurality of rectangular panels arranged to be laid side by side and fastened end to end in an array to cover rough ground to form a support surface;

each panel having a first surface and a second opposed parallel surface, a first end and second end;

each panel having a mounting arrangement defining the first and second ends of the panel for connection at the first end to a corresponding second end of a next adjacent panel having a cooperating mounting arrangement;

a first end of the mounting arrangement having a first connecting member extending along the first end which is generally L-shaped with a first plate attached to the first surface and a first flange substantially at right angles to the first plate;

a second end of the mounting arrangement having a second connecting member extending along the second end which is generally L-shaped with a second plate attached to the second surface and a second flange substantially at right angles to the second plate;

the first and second flanges being arranged in opposed directions so that one can engage over the other to hold the panels against movement away from one another;

and a third plate attached to the second surface at the first end and extending from the second surface to a position beyond the first end of the panel and underlying the first flange to define with an end of the first flange a slot through which the second flange is inserted.

* * * * *